US005459812A

United States Patent [19]

Taylor

[11] Patent Number: 5,459,812

[45] Date of Patent: Oct. 17, 1995

[54] IMMERSION HEATERS INCLUDING SHEET METAL HEAT CONDUCTION LINK

[75] Inventor: John C. Taylor, Arbory, Isle of Man

[73] Assignee: Strix Limited, Castletown, Isle of Man

[21] Appl. No.: 30,044

[22] PCT Filed: Sep. 16, 1991

[86] PCT No.: PCT/GB91/01579

§ 371 Date: Mar. 16, 1993

§ 102(e) Date: Mar. 16, 1993

[87] PCT Pub. No.: WO92/05675

PCT Pub. Date: Apr. 2, 1992

[30] Foreign Application Priority Data

Sep. 17, 1990 [GB] United Kingdom ..... 9020309
Jan. 17, 1991 [GB] United Kingdom ..... 9101018

[51] Int. Cl.[6] ..... H05B 3/82

[52] U.S. Cl. ..... 392/498; 392/501

[58] Field of Search ..... 219/523, 437; 392/497–501, 449–457, 485, 487, 489, 455; 337/380

[56] References Cited

U.S. PATENT DOCUMENTS

| | | | |
|---|---|---|---|
| 2,802,921 | 8/1957 | Miklas | 392/455 |
| 2,977,454 | 3/1961 | Volker | 392/498 |
| 3,715,567 | 2/1973 | Mandziak | 219/437 |
| 4,041,433 | 8/1977 | Watson | 337/380 |
| 4,068,116 | 1/1978 | McKinstry . | |
| 4,730,099 | 3/1988 | Bleckman | 392/498 X |
| 4,835,366 | 5/1989 | Owen et al. | 392/498 X |

FOREIGN PATENT DOCUMENTS

| | | | |
|---|---|---|---|
| 734077 | 5/1966 | Canada | 219/437 |
| 208028 | 3/1984 | Germany | 392/498 |
| 892685 | 3/1962 | United Kingdom . | |
| 1145994 | 3/1969 | United Kingdom | 392/498 |
| 2052227 | 1/1981 | United Kingdom . | |
| 2103460 | 2/1983 | United Kingdom . | |

*Primary Examiner*—Teresa J. Walberg
*Attorney, Agent, or Firm*—Burns, Doane, Swecker & Mathis

[57] ABSTRACT

An immersion heater includes a heating element having a return portion around which is wrapped a thermally conductive link. The link extends through a plastic head and seal member, by which the element is mounted in an opening in a wall of a heating chamber, and has a first portion bent down to cooperate with a bimetallic actuator of a thermally responsive control, which operates in the event that the element overheats. A second portion of the link is bent upwardly, its upper end cooperating with a thermally deformable member of the control which, in the event that the actuator fails to operate, will deform so as to disconnect the power supply to the element.

29 Claims, 12 Drawing Sheets

1
2
3
4
5
6
7
8
9
10
11
12
13
14
15
Bimetal
B 324
323
334'
321
340
338
309
339
341
322
342
300
316
326
315
333-Thermal Fuse
312
328
332
301
330
Bimetal 327
306
304
307
305
308
311
320
325
350
337
Stainless Steel Cladding 305A

IMMERSION HEATERS INCLUDING SHEET METAL HEAT CONDUCTION LINK

This invention relates to electric immersion heaters.

Traditionally, electric immersion heaters which are used, for example, in kettles, hot water jugs, washing machines, dishwashers and other water heating appliances comprise a metal sheathed element which is brazed to a metal element head which is mounted to overlie and is sealed with respect to an opening in a wall of a liquid containing chamber of an appliance. The element is brazed to the head at both its end portions, where the element sheath extends through the head to project by a small amount on the dry side of the head. The element is formed so that a so-called hot return portion, which is a portion intermediate the ends, .is bent back against the head and brazed thereto. As shown, for example in GB 2052227, a thermally-sensitive actuator of a control is commonly arranged in thermal contact with the side of the head opposite the hot return i.e. the dry side, so that should the element overheat, for example when the appliance is switched on dry or boils dry, the temperature rise in the hot return portion of the element is conducted through the head to the actuator which, at a predetermined temperature, operates the control to interrupt the power supply to the element and thus de-energises the element.

In GB 892685 which relates to electric kettles, the hot return portion is not brazed to the head directly but rather to a copper stud which is carried by the head. A copper screw engages with the stud through the head and in turn locates a copper plate which mounts a two part bimetallic actuator which, in the event that the element overheats, opens a switch. This is a complicated construction of high thermal capacity with a long thermal path between the element and the actuator, and accordingly has a very slow response time to a dry switch on or boil dry condition.

SUMMARY OF THE INVENTION

According to one aspect of the present invention, an electric immersion heater includes a metal sheathed heating element formed to provide two end portions and an intermediate return portion adjacent the end portions. The electric immersion heater further includes a heat conduction link of sheet material of high thermal conductivity attached at a first end to and extending substantially completely around the return portion of the element in good thermal contact therewith. A second end of the heat conduction link and the end portions of the element are arranged so that in use they are adapted to extend through a sealing means disposed in at least one opening in a wall of a liquid heating chamber such that, from outside the chamber, electrical connections can be made to the end portions of the element and thermally-responsive control means can be associated with the second end of the heat conduction link.

By utilising a heat conduction link of sheet material the surface area for transfer of heat from the element to the link is large compared with the thermal conduction cross-sectional area of the link. A quick response to a boil-dry or switch-on-dry condition is thus ensured. Also by providing a short length of the link within the chamber exposed to liquid therein, the large surface area of the link over this length relative to its conductive cross-sectional area will result in the free end of the link reflecting the temperature of the liquid within the chamber so that a multi-purpose control can be provided which serves to control the temperature of the liquid in normal operation in addition to fulfilling its safety function in a boil or vaporise-dry or switch-on-dry condition.

In a preferred arrangement, the link is at least five times as wide as it is thick in the region of contact with the element, whereby a large area of contact is obtained, relative to the heat-transmitting cross sectional area of the link.

Preferably, the link is made from copper, although other high thermal conductivity materials could be used. It may also be plated, or clad with stainless steel, for example, if required for purposes of strength and appearance. Where the cladding is of a low thermal conductivity material, this should preferably be provided solely on that side of the link which in use does not contact the return portion of the heater, so as not to reduce the heat transfer to the link. The link may also provide a convenient earth connection for the element sheath.

Preferably the link extends completely or at least to a major extent around the return portion of the element, whereby the link receives heat from substantially the whole or a major extent of the periphery of the element. Thus although the link may be brazed, welded or soldered to the element, in a particularly preferred embodiment, it is wrapped around the element and secured back onto itself, by welding, brazing or riveting, for example. It could also be held around the element by resilient clamping means, for example a spring clip.

It would also be possible to bifurcate the portion of the link extending around the element return so that it may extend in two sections over a greater length of the element in a helical manner.

A thermally-responsive bimetallic actuator of a thermally responsive control may be associated with, as for example by being mounted on, the free end of the link. Such an actuator is preferably a snap-action bimetallic actuator. Such bimetallic actuators are common in the art, and examples are described in GB 1542252 and GB 657434. It will be appreciated however that other bimetallic actuators, for example creep-action bimetallic actuators, may equally well be used, depending on the application. The actuator may be mounted on the link either before or after the end portions of the element and the link have been passed through the sealing means. As an alternative to being fixedly mounted on the free end of the link a bimetallic actuator may be urged against the link by suitable means, so as to be in good thermal contact therewith. Heat sink compound may be provided between the link and the bimetallic actuator to improve thermal contact, if necessary.

The link may be of differing widths along its length to give the desired response. If for example a relatively large bimetallic actuator is to be mounted on its free end, the free end of the link may be wider than the said one end portion, to increase heat transfer to the actuator. If it is found that too much heat is conducted through the link to the actuator with the result that the actuator operates prematurely, the width of the link may be reduced locally to introduce increased thermal resistance and thus slow down the transfer of heat to the actuator.

As in an immersion heater according to the present invention there is no requirement for the return portion of the element to be connected back to a metal head as with the conventional hot return and since earthing of the element may be achieved through the heat conduction link, a metal head can be dispensed with and the usual brazing of a head to the element ends and hot return portion avoided with substantial cost savings. For convenience in mounting the immersion heater of the present invention in an opening of the wall of a liquid heating chamber a plastics head and associated sealing means for engagement not only between the head and the opening but also between the head and the element end portions and heat link may be provided. Such a plastics head may be screwable to the heating chamber wall.

Although the element can be arranged so that its return portion is closely adjacent the sealing means, whereby in use the thermal conduction path via the heat link to the control is minimised for the quickest possible response to a boil-dry or switch-on-dry condition, it may as mentioned previously be advantageous in certain circumstances to space the return portion from the sealing means so that a short length of the link between the return portion and the sealing means will be exposed to liquid in the chamber. In such an arrangement the heat transmission to the free end of the link will be influenced both by the element temperature and by the liquid temperature.

Thus a control associated with the free end of the link may, in normal operating conditions with liquid in the chamber, act as a thermostatic control or a timing control for the heater, for example.. However if the chamber should be empty or boil or vaporise dry, the control may then act as a thermal overheat protector control for the heater. The response of the control will be dependent on several factors, for example the relative areas of contact of the link with the element and the liquid, and these may be chosen to give the required response having regard to the characteristics of the control employed.

It is of course possible for more than one control to be associated with the free end of the heat conduction link. For example, more than one bimetallic actuator could be mounted on or associated with the link. These actuators could be chosen to have different response temperatures, for example, so that an indication of rising liquid temperature could be obtained. The actuators could be disposed sequentially along the free end of the link for example, or in pairs, back to back on opposite sides of the link.

One control could be a primary overheat protector which acts to disconnect the power supply to the element in the event that the element overheats, and a second control could be a back-up protector (for example having a separate bimetallic actuator) which operates to disconnect the power in the event that the primary protector fails to operate.

In one embodiment a thermal fuse may be associated with the free end of the heat conduction link to act for example as the actuator for a secondary back-up control. Thermal fuses are well known in the art and act as a back-up protector to disable the heater in the event that the primary overheat protector, as described above, fails. In a particularly simple arrangement a thermally deformable member may be resiliently biased against a portion of the free end of the link so that should the overheat protection fail, the temperature of the free end of the link will rise to the extent that the fuse member will deform and move under the spring biasing force, the movement being used to open a set of contacts to disable the heater.

The arrangement of the thermally conductive link may be chosen to suit the particular application. In one embodiment, the free end of the link may extend substantially horizontally on the dry side of the sealing means and a bimetallic actuator be disposed horizontally on, for example, the upper surface of the link. This is a convenient arrangement where a vertical actuating movement is required. With such an arrangement a thermal fuse or back-up actuator may be positioned on the opposite side of the link, for example in a position closer to the element than is the bimetallic actuator. The closer the thermal fuse is positioned to the element, the quicker the response will be in the event that the primary overheat protection fails. Of course the positions of the fuse, and its deformation temperature can be chosen to give the desired operating characteristics in any particular application.

In an other embodiment, the link may have a portion extending horizontally through the seal from the element, with the free end formed at an angle to that portion, for example substantially at right angles thereto. This arrangement has the considerable advantage that a bimetallic actuator may be arranged for example generally vertically in contact with the link. In known thermal controls for electrical heating appliances, such as disclosed in GB 2181598 and GB 2217160 it is normal to arrange a bimetallic actuator in contact with a portion of a metallic element head which is in close thermal contact with a return portion of the element. The bimetallic actuator is mounted in a control unit which is mounted against the head so as to press the actuator into contact with that portion of the head. Such controls units can thus still be employed with the present invention by mounting them to, for example, a plastics head member as mentioned earlier with the bimetallic actuator in thermal contact with the free end of the link, which may be located against the head.

Control units of the above type may also include back-up protection in the form of a thermal fuse mounted in contact with the element head. The thermal link may therefore be configured to provide a portion against which the thermal fuse member may locate. In one embodiment the thermal link may have a free end having a first and second leg portions extending generally in opposite directions from each other, for example a first leg portion extending at right angles to the portion of the link which extends through the sealing means and against which a bimetallic actuator may locate, and a second leg portion also extending generally at right angles to the link portion extending through the sealing means, but in the opposite direction from the first leg portion, and against which the thermal fuse may locate. Such a link may easily be formed by releasing a tongue from a strip member, and bending the tongue at right angles to the strip. The tongue may then be inserted through the appropriate openings in a head and sealing means from the 'dry' side and passed around and secured to the element. The remainder of the strip on the dry side will then form two integral leg portions against which the appropriate control components can be located.

More conveniently, however, the link is formed at its free end with a pair of tabs which may be folded down to form the first portion, and a relatively thin strip extending between and preferably beyond the tabs which can be folded over to form the second portion. The end of this strip may also conveniently be configured to provide an earth link for the heater.

Although the element sheath may be of copper as is conventional, stainless steel or other material of low thermal conductivity is preferred to reduce the outflow of heat along the element after the control has operated in a boil-dry or switch-on-dry condition. The radial transfer of heat to the heat link is not significantly affected. As a heater according to the invention does not require a brazed or welded connection to a metal head, the difficulties in brazing or welding stainless steel is no inhibition to the use of this material for the element sheath of a heater according to the invention as is the case with conventional immersion heaters.

The present invention also extends to the combination of an electrical immersion heater as aforesaid and a thermally responsive control means therefor associated with the free end of said heat conduction link. The control and the immersion heater may conveniently be pre-assembled into a combined heater/control unit which is then mountable, as a unit, in an opening in a wall of a liquid heating chamber.

The control may include or be associated with a boiling control of the heating chamber, for example when used in kettles or hot water jugs. The boiling control may be remote from the control and connected mechanically or electrically thereto. In known controls, such as described in GB 2113010 a steam pipe is passed through and brazed into a hole provided in the metallic heater head. The pipe conducts vapour from an upper part of the chamber to a bimetallic actuator situated behind the head, which actuator operates when the liquid in the chamber boils. The arrangement described herein particularly facilitates such a control since the steam pipe may easily be passed through the plastics head and sealing member.

Preferred embodiments of the invention will now be described, by way of example only, with reference to the following drawings in which.

Figure 1:
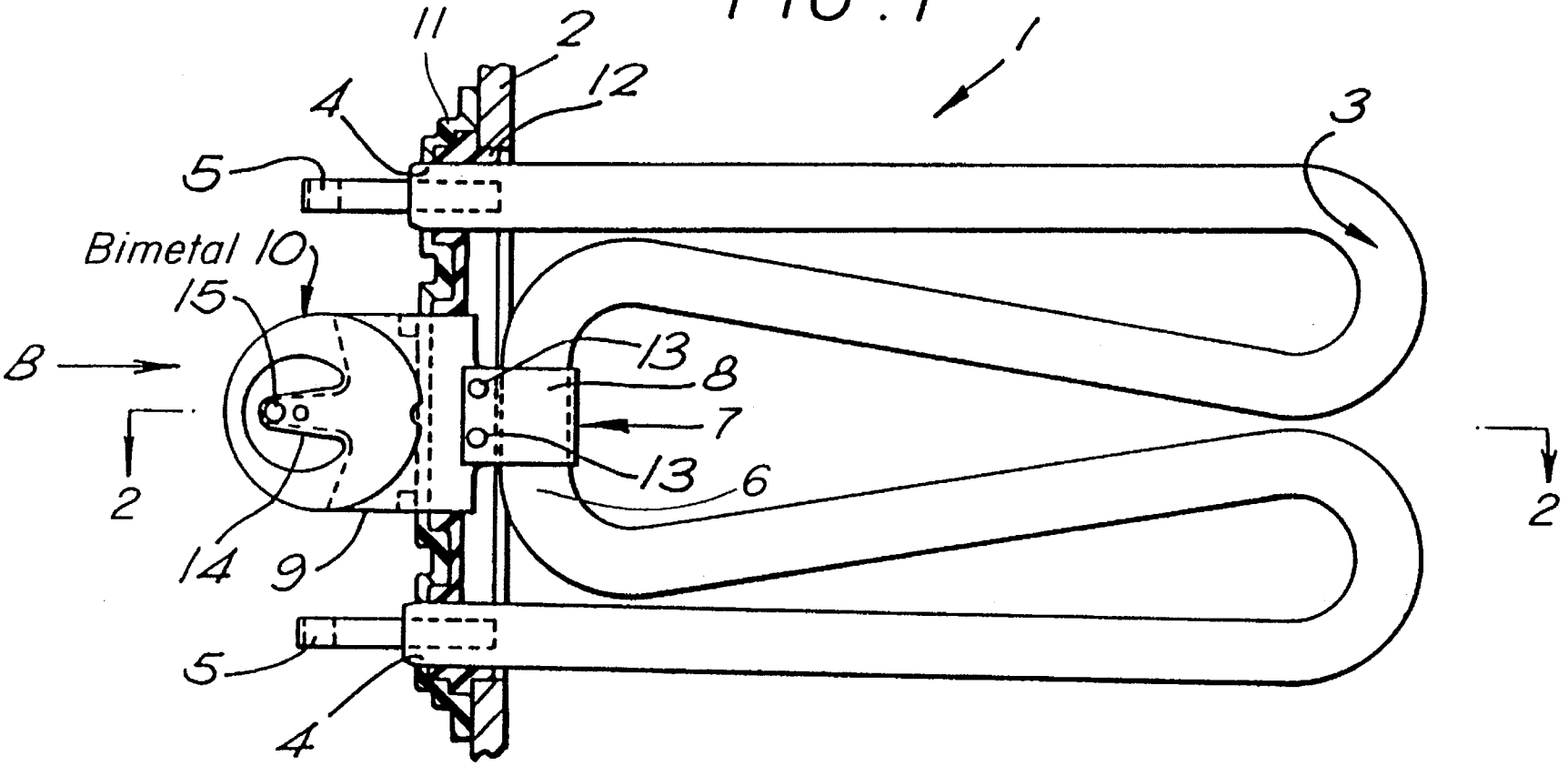
FIG. 1 shows a partially sectioned schematic plan view of a first embodiment of the invention.
Figure 2:
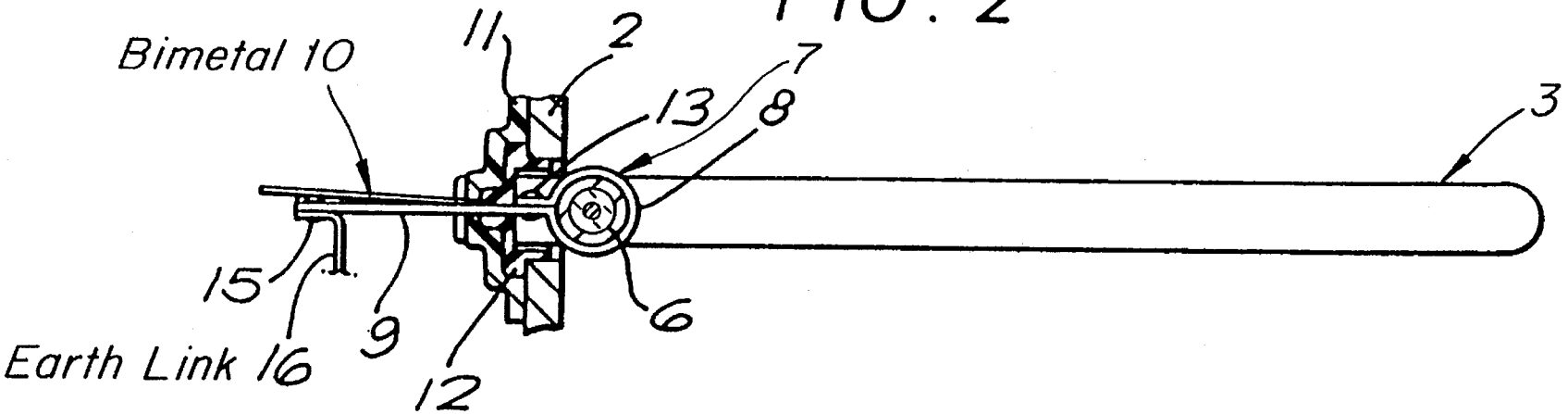
FIG. 2 is a partial schematic section along line 2—2 of FIG. 1.
Figure 3:
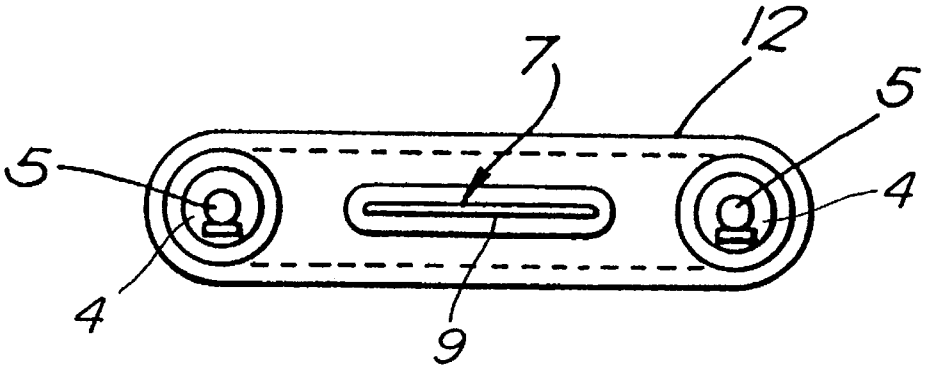
FIG. 3 is a schematic view in the direction of arrow 'B' in FIG. 1, with certain components removed for clarity.

Referring to FIGS. 1 to 3, an immersion heater 1 is mounted in an opening in a chamber or vessel wall 2. The heater has an element 3 having two end portions 4 from which project respective cold tails 5 i.e. terminal pins of low electrical resistance connected to the respective heating wire located within the element, for connection to a power supply, not shown. The element 3 has in addition, a return portion 6. The element shape is such that it is easy to compact during manufacture. A heat conduction link in the form of a copper strip member 7 has a first end portion 8 which is wrapped around the return portion 6 of the element 3 and a second free end portion 9 which mounts a snap-action, thermally-responsive bimetallic actuator 10. This actuator, which is of the type described in GB 1542252 is circular having a generally U-shaped opening which defines a central tongue 14. The actuator 10 forms part of a thermally-responsive control (not shown) including switch means arranged in the power supply to the element 3, to interrupt the power supply when the actuator operates at a certain, critical temperature.

The end portions 4 of the element and the middle portion of the strip member 7 pass through respective openings formed in a moulded plastics head 11, which may be part of a control housing for example, which overlies the opening in the vessel wall 2. A sealing member 12 of silicone rubber, for example, is arranged on the wet side of the head 11 and seals the periphery of the opening, and around the ends 4 of the element 3 and the strip member 7. The element 3 may be located axially in a desired position in the vessel by suitable means arranged, advantageously, on the dry side of the head 11.

Referring in greater detail to the copper strip member 7, this comprises a first end portion 8 which is wrapped around the return portion 6 of the element and which is secured back on itself by means of rivets 13. As can be seen from FIG. 1, the strip member 7 contacts the element 3 over a substantial length of the element, and, as can be seen from FIG. 2, over substantially the whole periphery of the element. This results in excellent heat transfer to the strip member 7. A second free end portion 9 of the strip member 7 is of greater width than the first portion 8 so that it is co-extensive with the bimetallic actuator 10, thereby improving heat transfer into the actuator 10 and thus its response.

The central tongue 14 of actuator 10 is mounted to the strip member 7 by means of a rivet 15 which also mounts an earth link 16 to the strip member 7. This link may act additionally as the means for locating the element 3 axially in the vessel opening.

It will be seen from FIG. 2 that the return portion 6 of the element 3 is spaced a short distance from the adjacent section of the sealing member 12, so that a region between the return portion and the sealing member contains liquid when the vessel is filled. Thus a length of the strip member 7 will be in contact with the liquid in the vessel and the temperature of the end portion 9 will depend not only to the temperature of the element but also on the temperature of the liquid. A desired response can be obtained by, for example, varying the relative areas of contact of the strip member 7 with the liquid and the element 3. It is possible therefore that the actuator 10 could operate as part of thermostatic control during normal use of the vessel, and as part of an overheat protector, should the vessel boil dry or the heater be switched on dry.

In this embodiment, prior to assembly to the water vessel, the end portions 4 of the element 3 and the free end portion 9 of the strip member 7 may first be passed through the sealing member 12 and the head 11 and the bimetallic actuator 10 then mounted to the free portion 9 of the strip member 7. This assembly may then be introduced into the opening in the vessel wall from outside, with head 11 being secured to the vessel wall 2, by screws for example, to compress and seal the sealing member 12 within the opening. It would be possible, alternatively, to mount the bimetallic actuator 10 on the free end portion 9 of the strip member 7 after the element has been positioned in the vessel wall.

Figure 4:
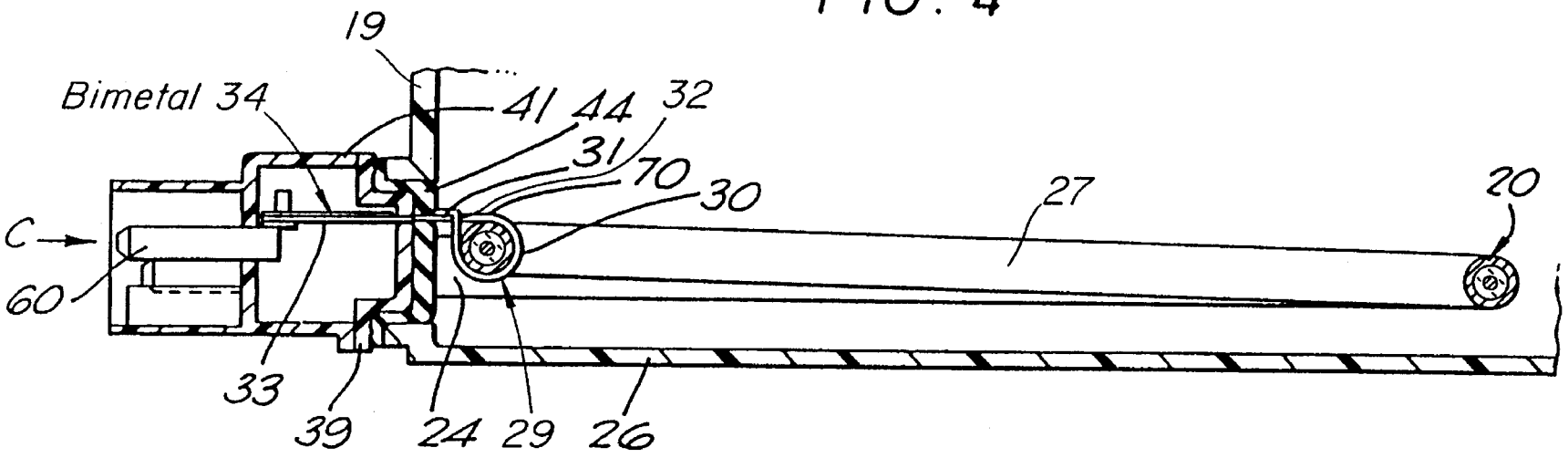
FIG. 4 is a partially sectioned schematic elevation view of a second embodiment of the invention.
Figure 6:
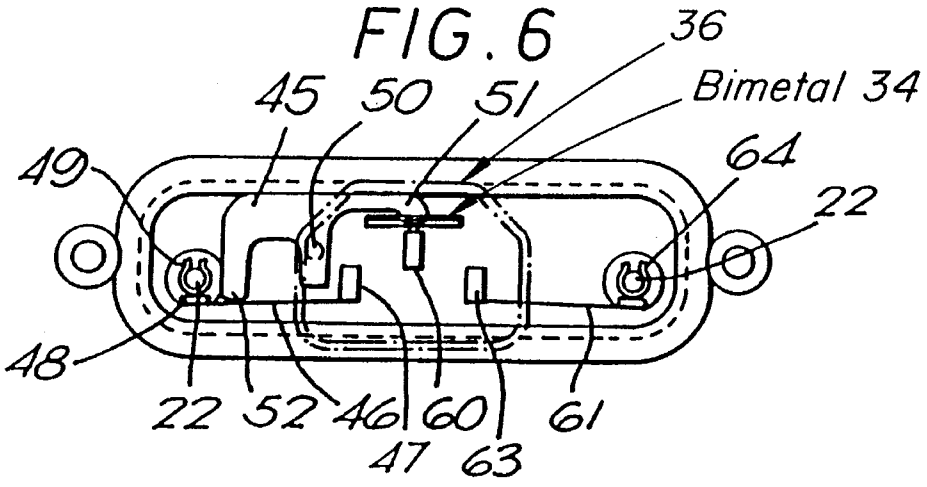
FIG. 6 is a schematic end view along arrow 'C' of the element shown in FIGS. 4 and 5.
Figure 5:
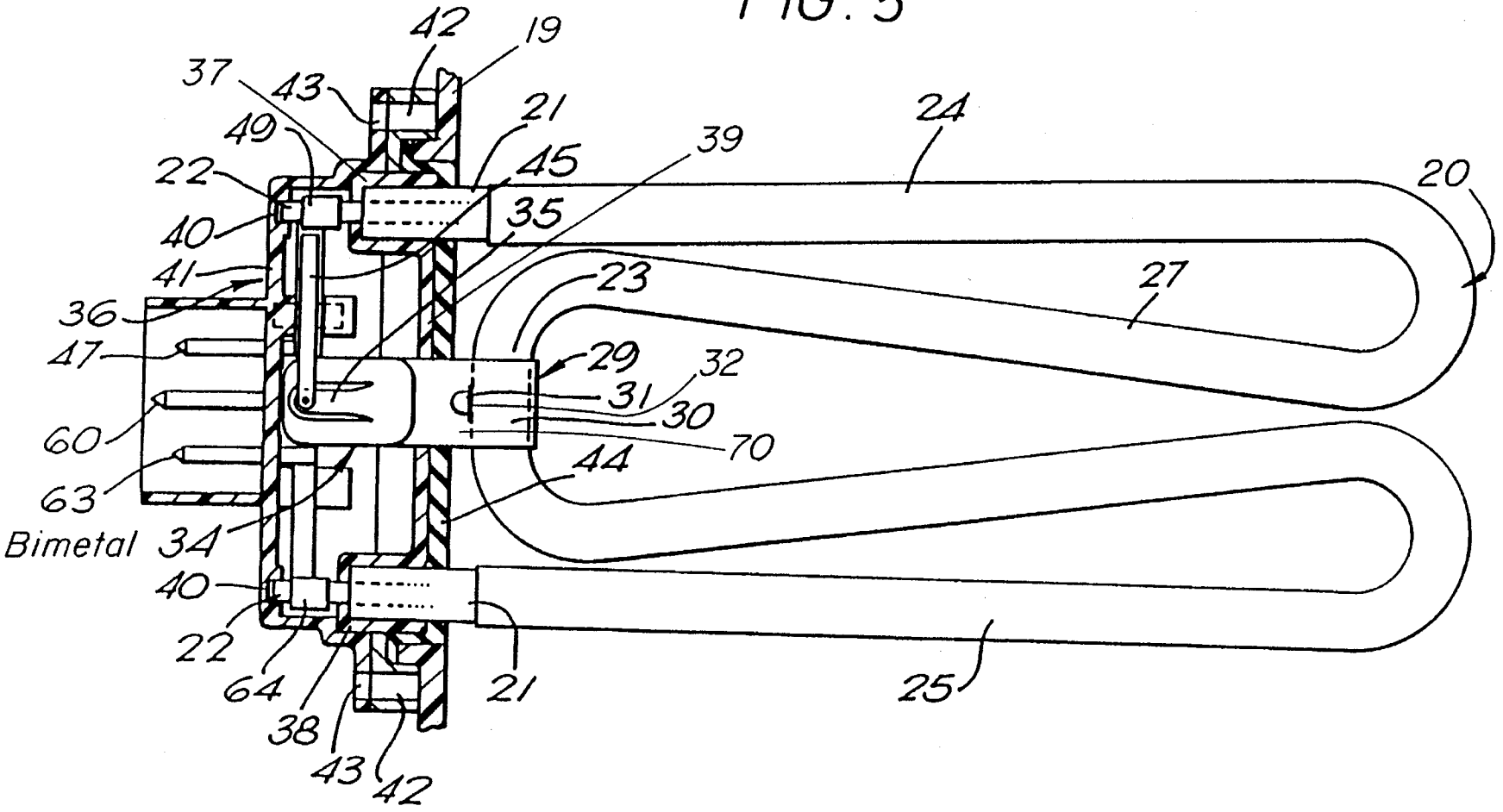
FIG. 5 is a partially sectioned schematic plan view of the embodiment of FIG. 4.

FIGS. 4 to 6 show, schematically, a second embodiment of the invention.

An element 20 has two end portions 21, from which project respective cold tails 22, for example of mild steel. The element 20 is also formed to provide a return portion 23 adjacent the end portions 21. The legs 24, 25 of the element become closer together towards their end portions 21, and are parallel to the bottom wall 26 of the vessel. As can be seen from FIG. 4, the return portion 23 is arranged so as to extend slightly above the plane of the legs 24, 25, with the portions 27, 28 of the element sloping downwardly from the return portion 23 to the legs 24, 25. This arrangement has the advantage that should the kettle boil dry, the return portion 23 will become uncovered first and thus overheat, with the result that the control will operate without the whole of the element necessarily overheating.

A heat conduction link in the form of a generally rectangular copper strip member 29 has a first end portion 30 which is wrapped around the return portion 23 of the element 20. For this purpose that end portion 30 of the strip member 29 is formed with a tang 31 which is inserted through a slot 32 in the strip member and then bent over. It will be noted that the strip member 29 is in contact with approximately three quarters of the periphery of the return portion 23. The strip member 29 also has a second, free end portion 33 against which a thermally-responsive snap-acting bimetallic actuator 34 is mounted. This actuator is of a type described in GB 657434, being generally rectangular with a U-shaped cut out defining a tongue 35. The actuator 34 forms part of a thermally-responsive control 36 which interrupts the power supply to the element 20 when the actuator 34 operates at a certain critical temperature as will be described later.

The free end portion 33 of the strip member 29 is connected to the earth terminal pin 60 by suitable means whereby the sheath of the element is earthed. This connection may also serve to locate the element axially in the opening in the vessel wall.

The end portions 21 of the element 20 engage and locate within respective wells 37,38 formed in a moulded plastics head 39 which overlies the opening in the vessel wall. The cold tails 22 of the element project through the wells 37, 38 to engage in locating recesses 40 formed in a moulded plastics control housing 41. The head 39 and control housing 41 have aligned bores 42, 43 whereby they may be mounted to the vessel wall 19 by screws (not shown). The control housing 41 also mounts the line, neutral and earth terminal pins by which electrical connection is made to the heater. The middle portion of the strip member 29 passes through a corresponding opening in the head 39. The ends 21 of the element legs 24, 25 and the middle portion of the strip member 29 pass through, and are sealed by, a silicone rubber sealing member 44 which is arranged between the head 39 and vessel wall 19 and which also serves to seal the opening in the vessel wall 19.

As in the earlier embodiment a portion 70 of the lo strip member 29 will be in contact with any liquid in the vessel, and the actuator 34 will therefore be responsive not only to the temperature of the element 20, but also to some extent to the temperature of the liquid. Thus in this embodiment also, the control 36 could function as a thermostatic control during normal use of the vessel, and as an overheat protector in the event the vessel should boil or vaporise dry or be switched on dry. It will be seen that central portion 70 of heat conduction link member 29 extends tangentially to the return portion of the element and will then be the first to be uncovered in a boil dry solution and will be initially uncovered if the element were to be energised only partially covered.

The thermally-responsive control 36 comprises the bimetallic actuator 34, a rocker member 45, a leaf spring 46 mounted at one end to one of the line or neutral terminal pins 47 and carrying a contact 48 at its other end, and a contact 49 formed as a copper sleeve mounted on the cold tail 22 of the element 20. The rocker member 45 is pivotally mounted in the control housing 41 in a bearing 50.

A further leaf spring 61 with a contact 62 is mounted to the other of the line or neutral terminal pins 63 and the other cold tail 22 is provided with a copper sleeve contact 64 in the control housing moulding 41.

One end portion 51 of the rocker member 45 locates against the tongue 35 of the bimetallic actuator 34, while the other end portion 52 engages the leaf spring 46 adjacent the contact 48. The resilience of the leaf spring 46 keeps the contacts 48, 49 together and pivotally biases the end 51 of the rocker member 50 into contact with the tongue 35. The actuator 34 is held in contact with and located on the end portion 33 of link member 29 by suitable means, for example an extension of the sealing member 44. Heat transfer compound may be used between the actuator 34 and the end portion 33 to improve heat transfer.

It will be apparent that heat will be conducted through the strip member 29 to the bimetallic actuator 34 which will operate at a certain critical temperature by deflecting its tongue 35 upwards with a snap action. This will cause the rocker member 45 to rotate about its mounting 45, to displace the leaf spring 46 downwardly, thereby breaking the contacts 48, 49 and interrupting the power supply to the element 20. When the bimetallic actuator cools sufficiently, the tongue 35 will snap back to its original position, and the leaf spring 46 will deflect under its own resilience to remake the contacts 48, 49 and re-connect the power supply to the element 20.

The element 20 and control 36 will preferably be supplied as a complete unit only requiring the element to be inserted through-the opening in the vessel wall and the control mounted thereon to be screwed to the vessel wall, this act serving not only to mount the unit to the vessel wall but also to compress the sealing member 44 and thus provide the requisite seal between the heater and the vessel wall opening.

It will be appreciated that many modifications may be made to the above embodiments within the scope of the invention. For example, more than one bimetallic actuator may be provided associated with the conductive strip member to operate at different liquid temperatures. Such an arrangement could be of use, for example, in washing machines where cycles operate at predetermined liquid temperatures. Also, while in the second embodiment described above the bimetallic actuator is mounted separately to the strip member, it could also be supported in the control housing and moved into contact with the strip member as the control housing moulding is assembled to the vessel.

Figure 7:
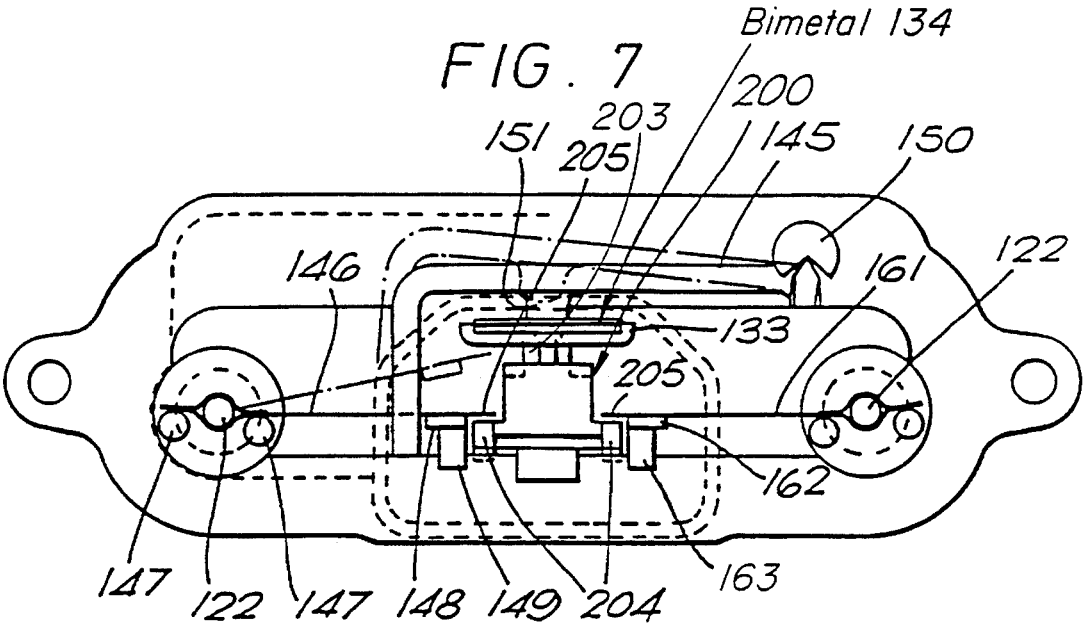
FIG. 7 is a schematic rear view of a further embodiment of the invention in the direction of arrow D in FIG. 8.
Figure 8:
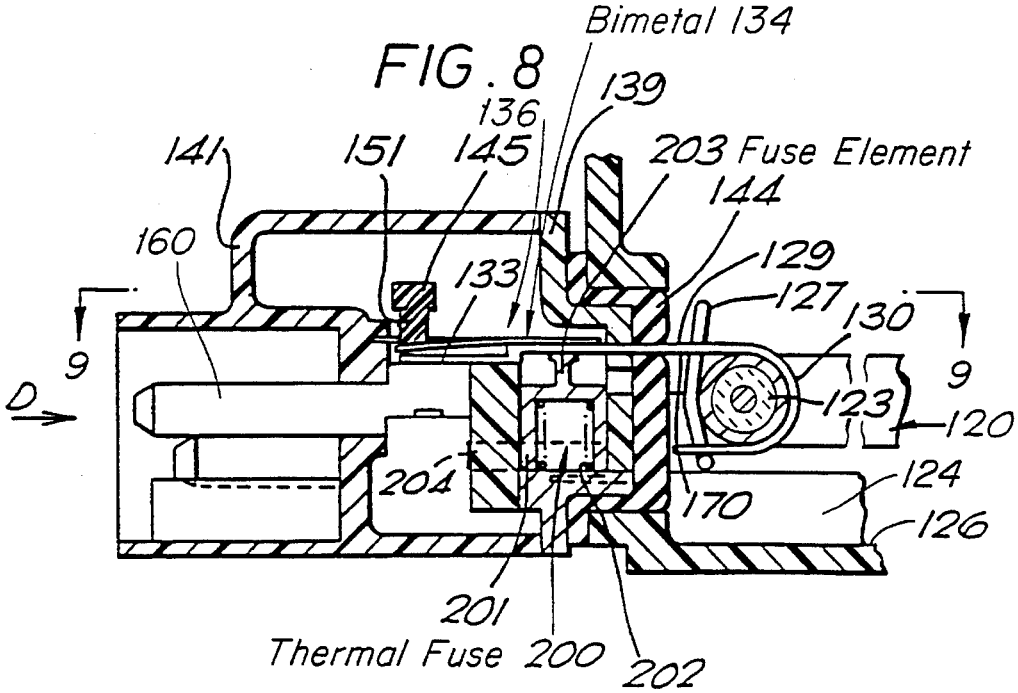
FIG. 8 is a schematic sectional view along the line 8—8 of FIG. 9.
Figure 9:
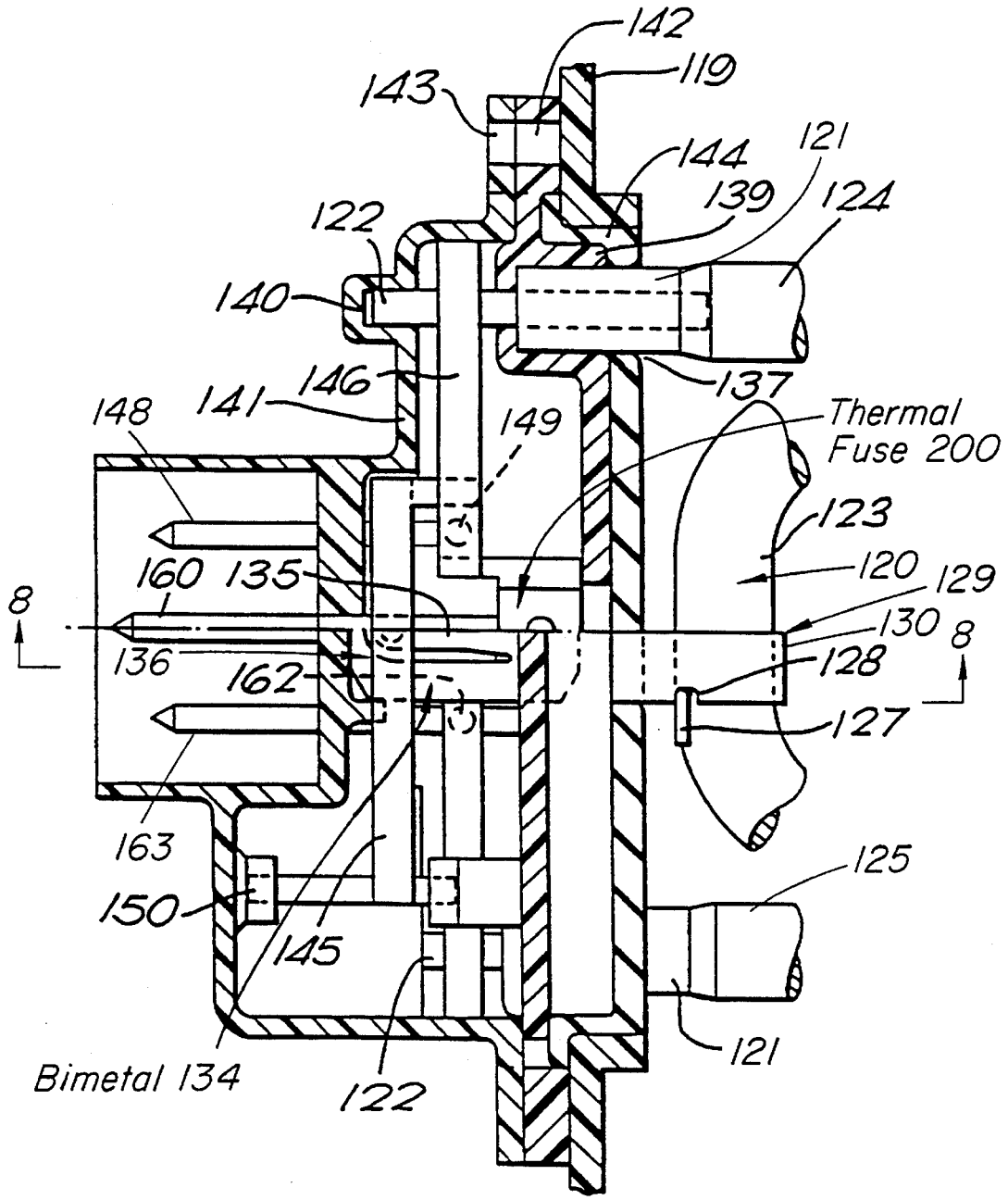
FIG. 9 is a schematic split section view along the line 9—9 of FIG. 8.

The embodiment of FIGS. 7 to 9 is similar to that of FIGS. 4 to 6. As in the earlier embodiment, an element 120 has two end portions 121, from which project respective cold tails 122, for example of mild steel. The element 120 is also formed to provide a return portion 123 adjacent the end portions 121. The legs 124, 125 of the element become closer together towards their end portions 121, and are parallel to the bottom wall 126 of the vessel. The return portion 123 is arranged so as to extend slightly above the plane of the legs 124, 125, so that should the kettle boil dry, the return portion 123 will become uncovered first and thus overheat, with the result that the control will operate without the whole of the element necessarily overheating.

A heat conduction link in the form of a generally rectangular copper strip member 129 has a first end portion 130 which is wrapped around the return portion 123 of the element 120 and is retained in position by a spring clip 127 which engages in slots 128 in the strip member 129. It will be noted that the portion 130 of the strip member 129 is in contact with approximately one half of the periphery of the return portion 123. The strip member 129 also has a second, free end portion 133 against which a thermally-responsive snap-acting bimetallic actuator 134 is mounted. This actuator is of a type similar to that described in GB 1542252 and GB 657434, being generally rectangular with a U-shaped cut out defining a tongue 135 and domed to prestress the blade. The actuator 134 forms part of a thermally-responsive control 136 which interrupts the power supply to the element 120 when the actuator 134 operates at a certain critical temperature as will be described later.

The free end portion 133 of the strip member 129 is connected to the earth terminal pin 160 by suitable means, for example by riveting whereby the sheath of the element is earthed. This connection may also assist in locating the element axially in the opening in the vessel wall.

The end portions 121 of the element 120 engage and locate within respective wells (only one of which is shown) formed in a moulded plastics head 139 which overlies the opening in the vessel wall. The cold tails 122 of the element project through the wells to engage in locating recesses 140 formed in a moulded plastics control housing 141. The head 139 and control housing 141 have aligned bores 142, 143 whereby they may be mounted to the vessel wall 119 by screws (not shown). The control housing 141 also mounts the line, neutral and earth terminal pins by which electrical connection is made to the heater. The middle portion of the strip member 129 passes through a corresponding opening in the head 139. The ends 121 of the element legs 124, 125 and the middle portion of the strip member 129 pass through, and are sealed by, a silicone rubber sealing member 144 which is arranged between the head 139 and vessel wall 119 and which also serves to seal the opening in the vessel wall 119.

As in the earlier embodiment a portion 170 of the strip member 129 will be in contact with any liquid in the vessel, and the actuator 134 will therefore be responsive not only to the temperature of the element 120, but also to some extent to the temperature of the liquid. Thus in this embodiment also, the control 136 could function as a thermostatic control during normal use of the vessel, and as an overheat protector in the event the vessel should boil or vaporise dry or be switched on dry. It will be seen that central portion 170 of heat conduction link member 129 extends tangentially to the return portion of the element and will then be the first to be uncovered in a boil dry solution and will be initially uncovered if the element were to be energised only partially covered.

The thermally-responsive control 136 comprises the bimetallic actuator 134, a rocker member 145, a leaf 10 spring 146 mounted at one end to the cold tail 122 and carrying a contact 148 at its other end, the contact 148 being resiliently biased by the leaf spring 146 against the upper surface of the line or neutral terminal pin 149. The rocker member 145 is pivotally mounted at one end in the control housing 141 in a bearing 150.

The leaf spring 146 may be, for example of beryllium copper, and the contact 148 may be of a standard copper backed, silver faced construction. The terminal pin 149, or at least its contact area may advantageously be of industrially pure copper or of a conventional construction, such as silver plated brass. The leaf spring 146 is mounted on the cold tail by a loop formed in its end. The loop is formed by providing two parallel slits in the end region of the spring and compressing that area to form the loop. Rotation of the leaf spring is prevented by stops 147.

A further leaf spring 161 resiliently biases contact 162 against a line or neutral terminal pin 163, the leaf spring being mounted in the same way to the other cold tail 122.

An intermediate projection 151 of the rocker member 145 rests against the tongue 135 of the bimetallic actuator 134, while the free end 52 engages underneath the leaf spring 146 adjacent the contact 148. This helps to maintain the projection 151 in contact with the bimetallic tongue 135. As in the earlier embodiment the actuator 134 may be held in contact with and located on the end portion 133 of link member 129 by suitable means, for example an extension of the sealing member 144. Heat transfer compound may be used between the actuator 134 and the end portion 133 to improve heat transfer.

It will be apparent that heat will be conducted through the strip member 129 to the bimetallic actuator 134 which will operate at a certain critical temperature by deflecting its tongue 135 upwards with a snap action. This will cause the rocker member 145 to rotate about its mounting 150, to pull leaf spring 46 upwardly, lo thereby breaking the contact between the contact 148 and terminal pin 149 and interrupting the power supply to the element 120. When the bimetallic actuator cools sufficiently, the tongue 135 will snap back to its original position, and the leaf spring 46 will deflect under its own resilience to remake the contacts and so re-connect the power supply to the element 120.

The control of this embodiment also includes backup protection such that should the control fail to operate, power will still be disconnected to the heater. The back-up protection is in the form of a thermal fuse 200. The thermal fuse comprises a generally cylindrical, hollow body 201 which houses a pre-stressed compression spring 202. On the upper surface of the body 201 is provided a projection 203. The projection 203 is formed of a material which will deform under the action of heat. The lower portion of the body 201 is provided with sidewardly extending lugs 204 which are arranged below extensions 205 of the leaf springs 146, 161.

In the event that the bimetallic actuator 134 fails to operate, the temperature of the thermal link 129 will continue to rise to the point at which the projection 203 will begin to thermally deform. The body portion will therefore be pressed forward by the force of the compression spring 202, to the extent that the lugs 204 will engage, and lift, the leaf spring extensions 205. The contacts 148 and 162 will therefore be lifted from the terminal pins 149, 163, to interrupt the power supply to the element 120. It will be apparent that once this protector has operated, the control will not reset automatically, and the thermal fuse will have to be replaced or the heater discarded. The body 201 is mounted so that it may rock from side to side so that should one set of contacts weld together, the body may still pivot so as to break the other set of contacts.

The closer the thermal fuse 200 is placed to the element 120, the sooner the heater will be disabled. As such, it may be possible with an arrangement as described above to do away with the stainless steel tray which is normally provided in the base of plastic jugs to protect the base from overheating elements.

Figure 10:
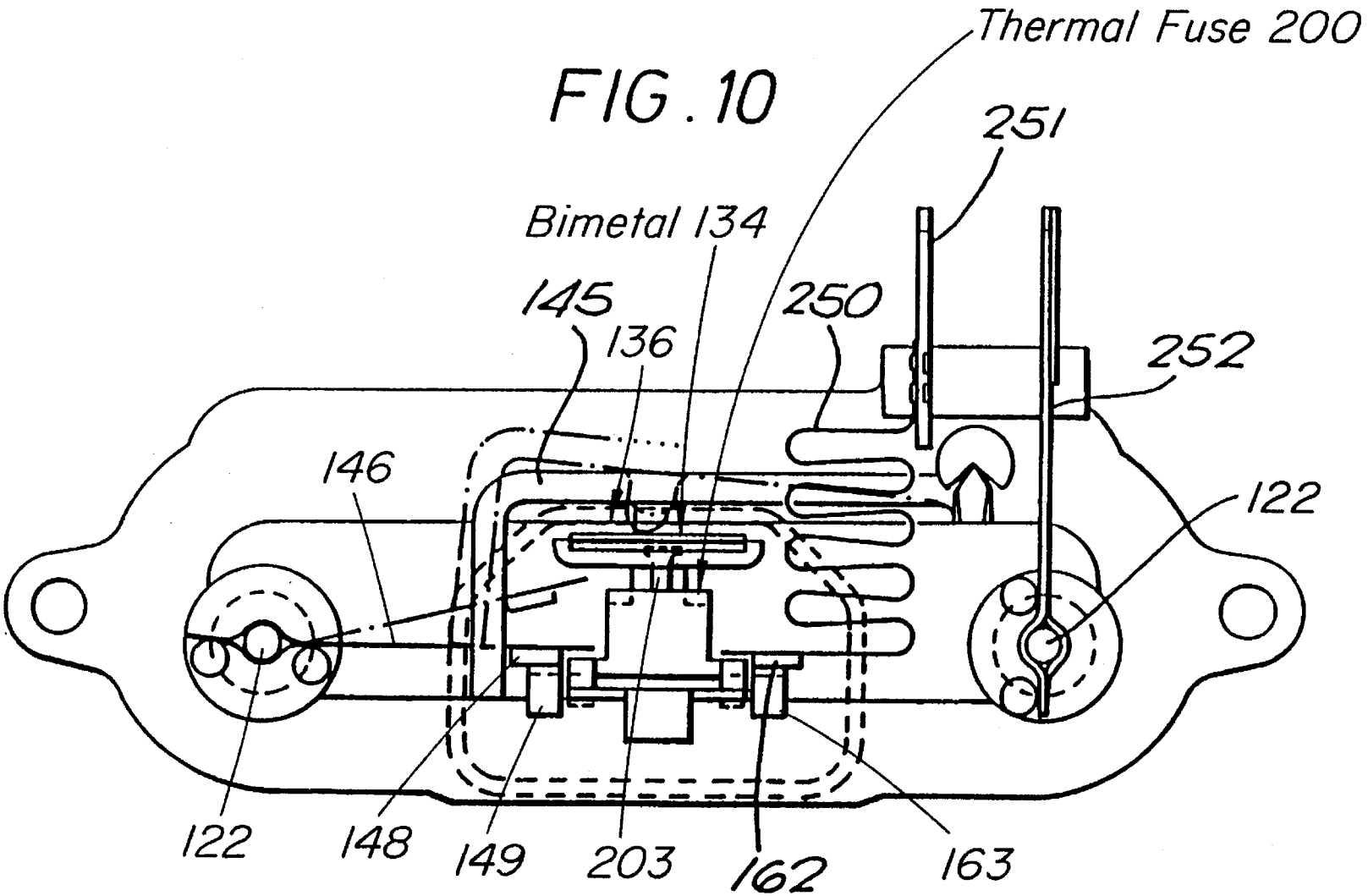
FIG. 10 is a rear view of a further embodiment of the invention.

The embodiment of FIG. 10 is similar to that of FIGS. 7 to 9 except that the contact 162 is mounted on the end of a resilient serpentine spring 250 which is connected at its upper end to a connector 251 for the lead of a steam control switch mounted in an upper part of the heater. The other lead of the steam control is attached to the upper end of connector member 252 which engages around the cold tail 122.

Figure 11:
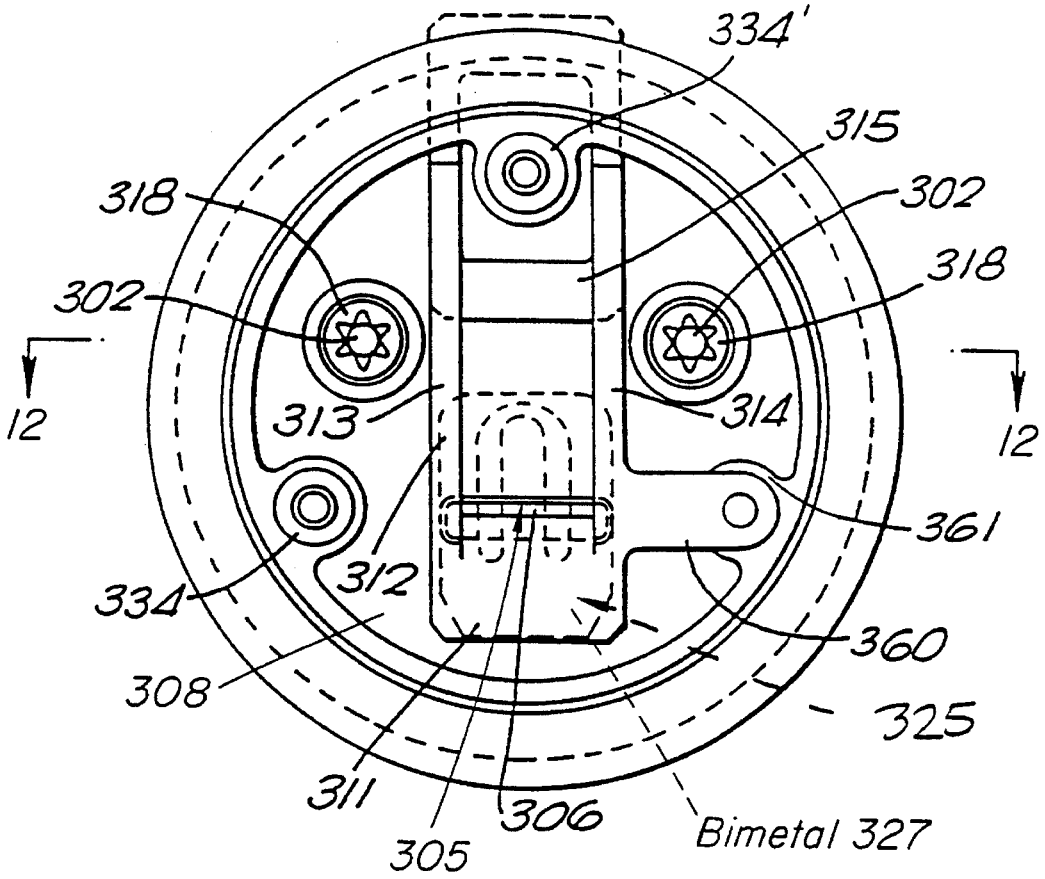
FIG. 11 is a rear view of yet another embodiment of the invention.
Figure 12:
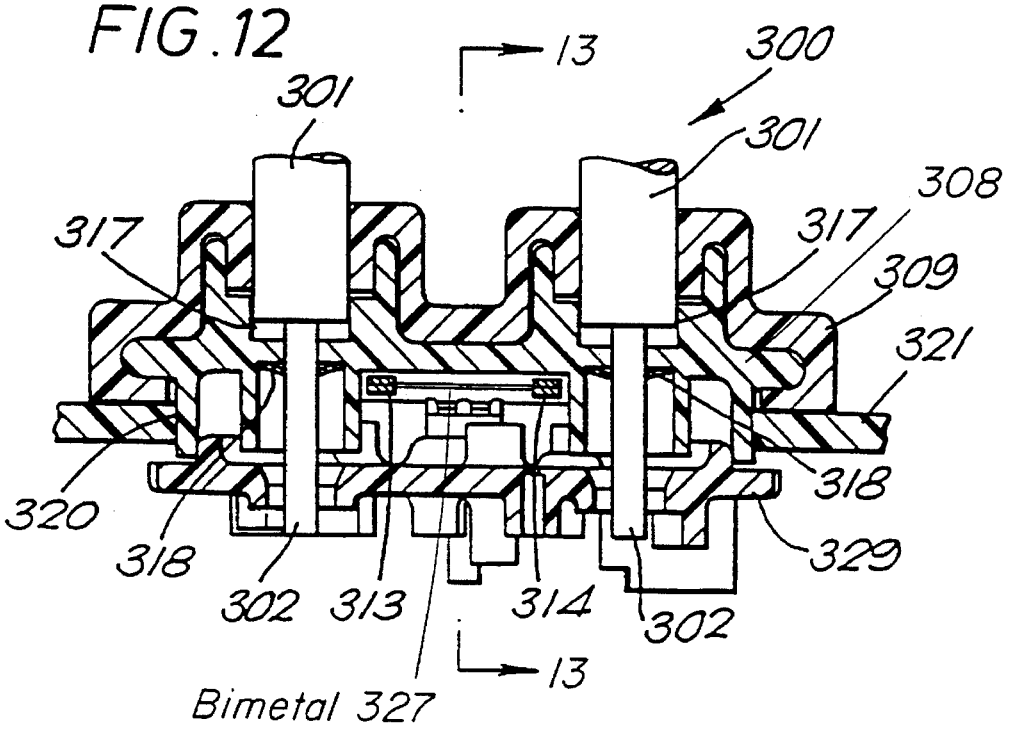
FIG. 12 is a sectional view of the embodiment of FIG. 11 along line 12—12, in combination with a control.
Figure 13:
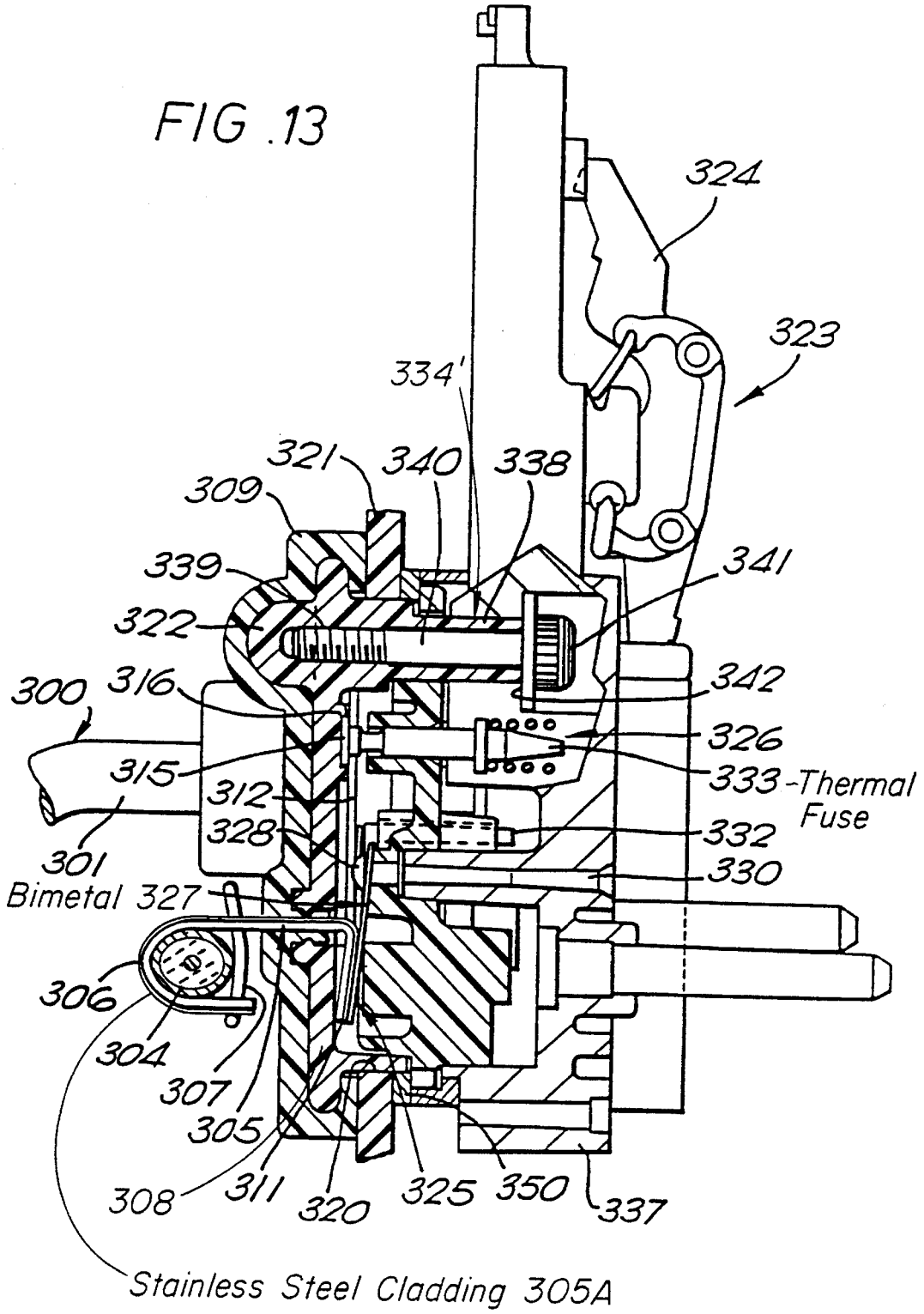
FIG. 13 is a sectional view along the line 13—13 of FIG. 12.

Turning to the embodiment of FIGS. 11 to 13, an element 300 has two end portions 301 from which project cold tails 302. The element 300 has a sheath of stainless steel, for example, and the cold tails 302 may be mild steel as is conventional in the art. The element 300 is formed with a return portion 304 adjacent the end portions 301, the end portions 301 lying in a plane above the return portion 304.

A heat conduction link in the form of a generally rectangular strip member 305 of a material having a high thermal conductivity has a first end 306 wrapped around the return portion 304 of the element 300 and retained in position by a stainless steel spring clip 307, as in the earlier embodiment. The strip 305 may be copper coated with stainless steel 305A, or other high thermal conductivity materials such as copper, monel or stainless steel coated aluminium, for example, depending on the material of the element sheath. The link 305 extends through a moulded plastics head 308 and a sealing member 309, and is bifurcated at its free end 310 to form a first leg portion 311 and a second leg portion 312 which locate against the back of the head 308.

The link 305 is made from a single strip of material. The first end 306 of the strip is formed by bending over a tongue which is formed in the strip by providing an elongate U-shaped slit in the strip, and pushing it through the head 308 and sealing member 309 from the rear of the head 308, whereafter it is wrapped and secured around the return portion 304 of the element 300. The first leg 311 of the other end of the link is formed by the unslit portion of the strip, while the second leg portion is formed by the material surrounding the released tongue. It thus comprises two parallel links 313,314 connected by a cross-link 315. The cross limb 315 is bent down from the position shown in dotted lines in FIG. 11 so as to lie slightly above the cold tails 302, and to engage with a complementary channel 316 formed in the head 308.

The end portions 301 of the element 300 engage in wells 317 in the head 308, and the cold tails 302 extend through the head 308 and are secured by spring washers 318. Thus the element 300, the link 305, the head 308 and the seal member 309 form an integrated sub-assembly which may be introduced into an opening 320 in a vessel wall 321 from the left, in the sense of FIG. 13, and located in the opening by a peripheral surface 322 of the head 308.

Once the sub-assembly has been positioned in the vessel wall 321, a control unit 323 may be associated with the free end of the thermal link 305. The control unit 323 shown schematically in FIG. 13 is substantially a standard thermally-sensitive control already manufactured by the applicant under the commercial code R32 and aspects of which are described in, for example, GB-A-2151598 and GB-A-2204450. The control unit 323 comprises an over-centre rocker mechanism 324 which is operated by a bimetallic actuator (not shown), in the event that liquid within the vessel boils, to open a set of switch contacts within the control to interrupt the power supply to the element 300. It also includes a primary overheat protector 325 and a back-up protector 326 which operates in the event that the primary overheat protector 325 fails.

The primary overheat protector comprises a domed, snap-action bimetallic actuator 327 of the type described in GB 1542257, or of a type similar to that described in GB 657434, for example. Preferably the actuator is rectangular. The bimetallic actuator 327 comprises a tongue 328 which is mounted to an inner moulding 329 of the control by a hammer drive screw 330, for example. The free end 331 of the actuator 327 contacts a push rod 332 which extends through the moulding 329 and cooperates with a set of switch contacts (not shown).

The back-up protector is generally of the type described in GB 2181598 and GB 2204450, and comprises a thermally deformable push rod 333 which is biased forwardly by a spring 334. An extension of the spring 334 cooperates with the set of steam contacts within the control unit.

The control unit 323 is mounted to the plastics head 308 such that the bimetallic actuator 327 locates against the first leg portion 311 of the link 305 and the free end of the rod 333 locates against the cross limb 315 of the second leg portion 312 of the link 305.

To locate the control unit 323 onto the head 308 in the correct orientation the head 308 is provided integrally moulded studs 334' which engage in complementary, aligned apertures 335, 336 in the inner control moulding 329 and an outer control moulding 337 respectively. Each stud 334' is provided with a central bore 338, the lower end 339 of which is threaded to receive a threaded bolt 340. The head 341 of bolt 340 abuts against a shoulder 342 provided in the outer control moulding 337.

The thermal link 305 is provided with an extension 360 which locates over a boss 361 in the head. An internally threaded brass stud (not shown) is staked into the boss 361 to provide a contact surface for the extension 360. A brass tube (not shown) is arranged in a corresponding bore in the control mouldings, the other end of the tube abutting the earth link in the control which connects with the earth pin. A further bolt 340 extends through the tube into the brass stud, clamping the earth link to the tube. Thus, an earth link is established to the element.

To assemble the control Unit 323 to the head 308, the head 308 is first inserted in the aperture 320 in the vessel wall 321. A condensation seal 350 is then slipped onto the portion of the head projecting through the aperture 320 and the control then presented to the head 308. The face of the bimetallic actuator 327 may be coated with a heat sink material, if required, to ensure good thermal contact with the first leg portion 311 of the link 305. The control mouldings 329,337 are aligned with the head 308 by engagement of the studs 334 in the corresponding apertures 335,336 in the mouldings 329,337, and the assembly secured in the vessel wall by introducing and tightening the bolts 340. As the bolts 340 are tightened, an inner lip 345 of the seal member is compressed between a peripheral flange 346 on the head 308 and the vessel wall 321 to seal this region. Also, the condensation seal 350 is compressed between the vessel wall 321 and the control mouldings 329,337. Excessive tightening of the bolts 340 is prevented by the studs 334' abutting the heads of the bolts 340. The act of mounting the control 323 to the head 308 pre-stresses the thermal fuse 333, against the cross limb 315, and brings the bimetallic actuator into thermal contact with the first leg portion 311 of the free end of the link 305.

In the event that the element. 300 should overheat, heat will be transmitted along the thermal link 305 to the first leg portion 311, and at a certain temperature, the actuator 325 will change its curvature causing movement of its free end 331 and the push rod 332 to open a set of contacts to disconnect the power supply to the element 300. Should this control fail, heat will continue to be transmitted through the link to the second end portion 112, and when the cross member thereof has risen to a sufficiently high temperature, the push rod 333 will deform and move under the force of the spring 334 to open a set of contacts to disable the element 300.

Figure 14:
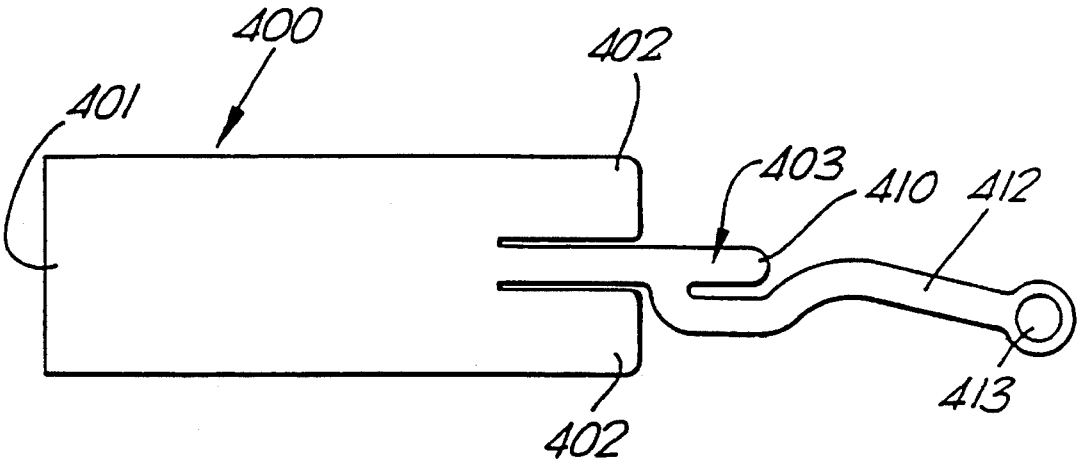
FIG. 14 shows a heat conducting link for a further embodiment.

FIGS. 14 to 17 show a modification of the embodiment of FIGS. 10 to 13. With reference to FIG. 14, a modified heat conduction link 400 comprises a generally rectangular portion 401, from which extends a pair of tabs 402 and a relatively narrow strip portion 403 extending therebetween. The link 400 is of copper and is clad with stainless steel 400A on one side only.

Figure 15:
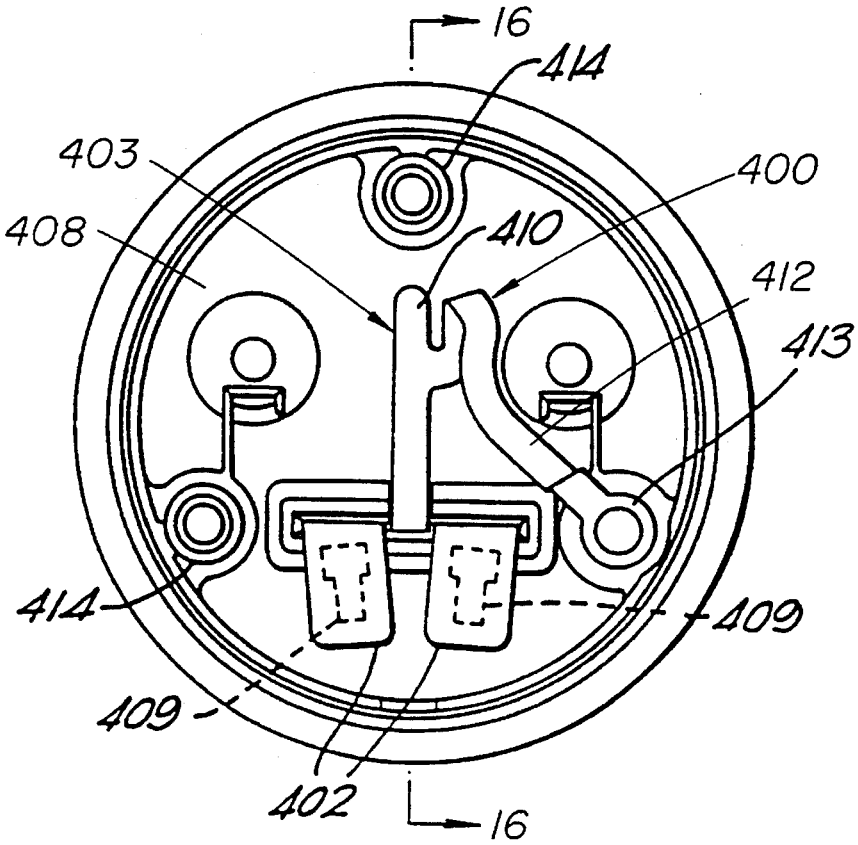
FIG. 15 shows a view of the heat link of FIG. 14 in situ.
Figure 16:
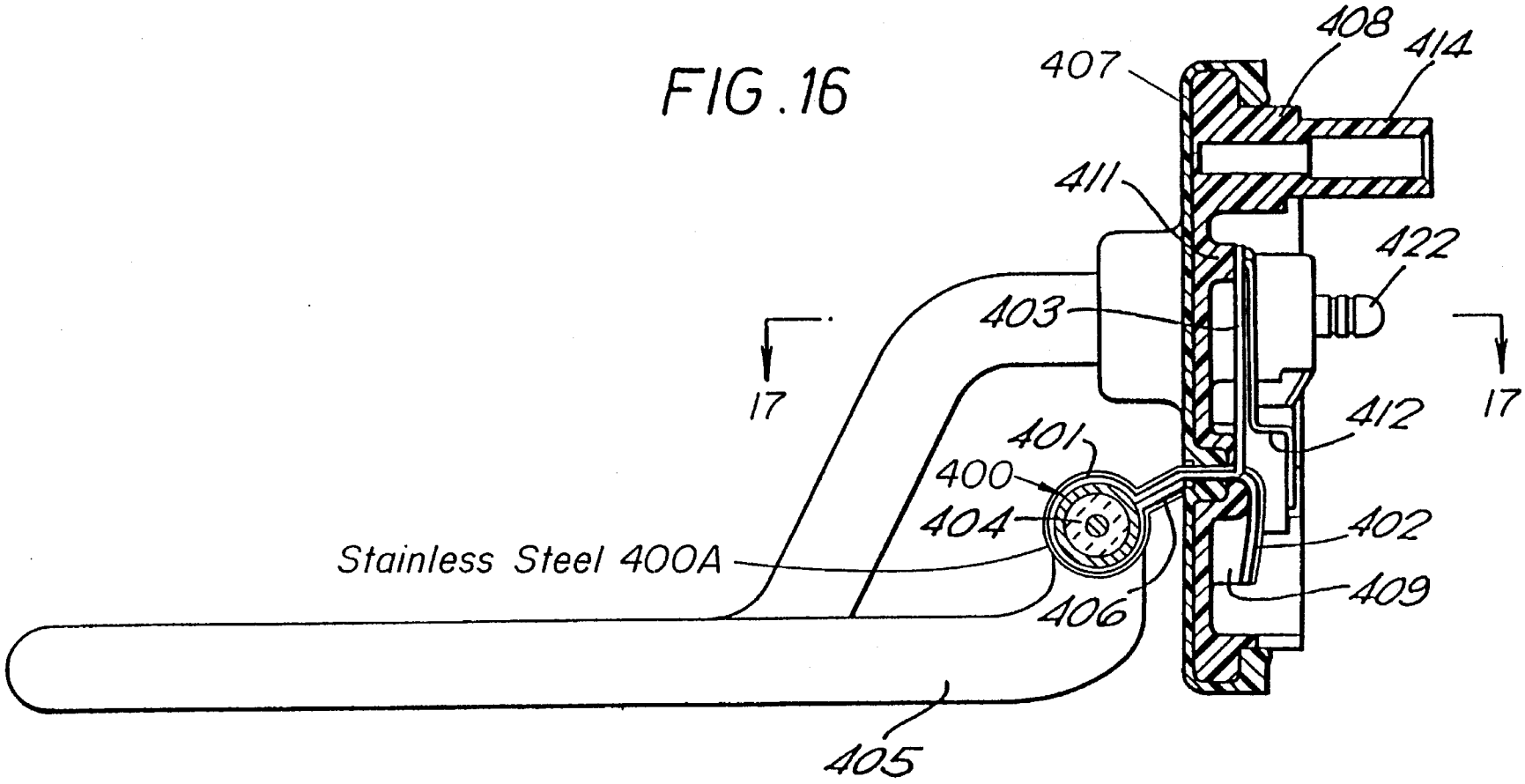
FIG. 16 shows a section along line 16—16 of FIG. 15.

As can be seen from FIG. 16, the rectangular portion 401 of the link 400 is wrapped around the hot return 404 of the element 405, being brazed back onto itself at portion 406. The link 400 passes through aligned openings in a silicone rubber seal member 407 and plastics head 408. The tabs 402 are bent downwardly (in the sense of FIG. 15) to abut against support pillars 409 formed in the head 408, whilst the strip portion is bent upwardly such that its upper end 410 abuts a support pillar 411 formed in the head 408. A side branch 412 extending from the middle region of the narrow strip portion 403 is bent in three dimensions, as seen in FIGS. 15 and 16 to provide an earth link, as in the earlier embodiment.

Figure 17:
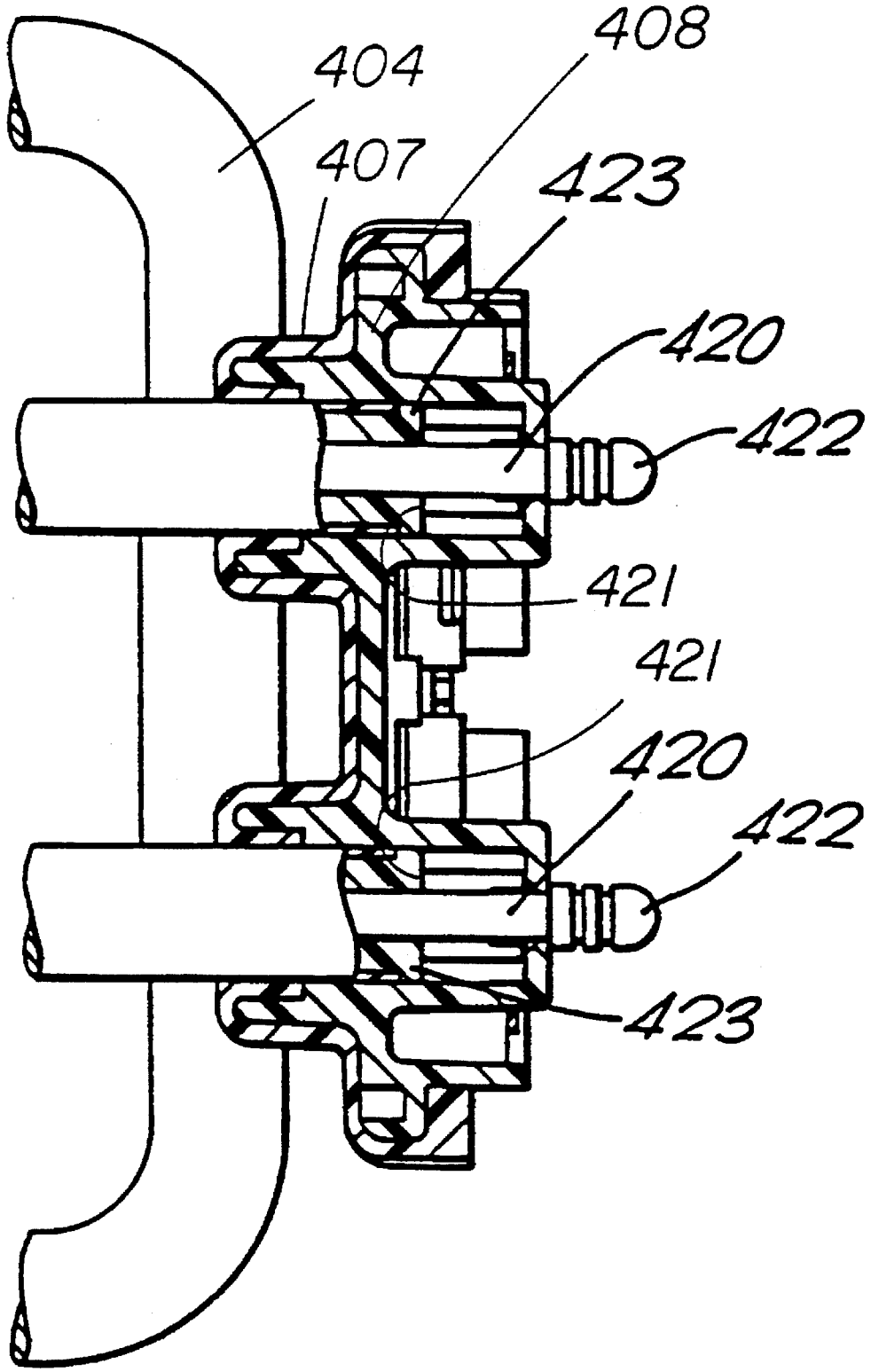
FIG. 17 shows a part section along line 17—17 of FIG. 16.

As will be seen from FIG. 17, in this embodiment the cold tails 420 of the element 405 project from wells 421 formed in the head 408, and are tipped with ferrules 422 for co-operation with leaf spring conductors (not shown) in the control. The end portions of the element sheath surrounding the cold tails 420 are filled with an epoxy resin 423 to prevent the accidental ingress of water to the element should the seal member 407 leak. Any space between the end of the sheath and the base of the wells 421 may be filled with a compatible epoxy resin during assembly.

As in the earlier embodiment, the element/head assembly is introduced through an opening in the side wall of a heating vessel, and a thermally sensitive control of the type generally described in GB 2181598 and GB 2204450 engaged over two internally threaded mounting studs 414 formed in the heater head 408, and the control bolted to the head to mount the heater in the opening as in the previous embodiment. One bolt passes through and contacts the hole 413 formed at the end of branch 412 to form the earth link to the element. The inner moulding of the control housing is generally similar to those commercially available, suitably modified to accept a rectangular bimetallic actuator.

It will be appreciated that various changes can be made to the above embodiment without departing from the inventive concept. For example, while in some embodiments, the bimetallic actuator is mounted on the heat conduction link by being clamped onto the link by the sealing member, the movement of the tongue of the actuator being used to actuate a control, it is of course possible and in certain cases preferable, that the actuator could be mounted to the link by its tongue (by riveting for example) and the movement of the free end of the actuator used to actuate the control.

In relation to the heat conductive link, it should be appreciated that the term free end is intended to define that portion of the link away from the return portion of the heater element.

While this invention has been illustrated and described in accordance with a preferred embodiment, it is recognized that variations and changes may be made therein without departing from the invention as set forth in the claims.

I claim:

1. An electric immersion heater comprising:

a metal sheathed heating element formed to provide two end portions and an intermediate return portion adjacent the end portions; and a heat conduction link of sheet material of high thermal conductivity attached at a first end to and extending substantially completely around the return portion of the element in good thermal contact therewith, a second end of the heat conduction link and the end portions of the element being arranged so that in use they are adapted to extend through sealing means disposed in at least one opening in a wall of a liquid heating chamber such that, from outside the chamber, electrical connections can be made to the end portions of the element and thermally-responsive control means can be associated with the second end of the heat conduction link.

2. An electric immersion heater as claimed in claim 1 wherein the link is at least five times as wide as it is thick in a region of contact with the element.

3. An electric immersion heater as claimed in claim 1 wherein the link is made from copper.

4. An electric immersion heater as claimed in claim 1 wherein the link is clad on one side with stainless steel.

5. An electric immersion heater as claimed in claim 1 further comprising a head member for mounting the element in an opening in a wall of a liquid heating chamber, the end portions of the element and the link extending through the head member.

6. An electric immersion heater as claimed in claim 5 wherein the head member is of plastic.

7. An electric immersion heater as claimed in claim 5 or 6 further comprising sealing means arranged in the head member and extending around the link and the end portions of the element.

8. An electric immersion heater as claimed in claim 5 or 6 wherein the second end of the link extending through the head member is folded back to lie generally parallel to the head member.

9. An electric immersion heater as claimed in claim 8 wherein the second end of the link has a first portion folded in one direction to lie generally parallel to the head member and a second portion folded in an opposite direction, also to lie generally parallel to the head member.

10. An electric immersion heater as claimed in claim 8 further comprising a thermally sensitive control for the heater, the control comprising a thermally-responsive actuator for disabling the heater in the event that the element overheats in use, the actuator being in thermal contact with the link.

11. An electric immersion heater as claimed in claim 10 wherein the actuator is a part of an integrated control unit which is mounted to the head member, the actuator being urged into contact with the folded back portion of the link.

12. An electric immersion heater as claimed in claim 11 wherein the control comprises a secondary actuator associated with the link arranged and adapted so as to operate in the event that the primary actuator fails to operate to disconnect the power supply to the element.

13. An electric immersion heater as claimed in claim 10 wherein the control comprises a secondary actuator associated with the link arranged and adapted so as to operate in the event that the primary actuator fails to operate to disconnect the power supply to the element.

14. An electric immersion heater as claimed in claim 13 wherein the secondary actuator is a thermally deformable member resiliently biased into contact with the second end of link.

15. An electric immersion heater as claimed in claim 14 wherein the second end of the link has two portions, extending generally in opposite direction from each other, the actuator engaging a first of the portions and a thermal fuse engaging a second of the portions.

16. An electric immersion heater as claimed in claim 15 wherein the second end of the link is formed with a pair of tabs which are folded down to form the first portion, and a relatively narrow strip extending between and preferably beyond the tabs which is folded to form the second portion.

17. An electric immersion heater as claimed in claim 1 further comprising a thermally sensitive control for the heater, the control comprising a thermally-responsive actuator for disabling the heater in the event that the element overheats in use, the actuator being in thermal contact with the second end of the link.

18. An electric immersion heater as claimed in claim 17 wherein the link extends generally parallel to the element, and the actuator produces an actuating movement generally perpendicular thereto.

19. An electric immersion heater as claimed in claim 17 wherein the control comprises a secondary actuator associated with the link arranged and adapted so as to operate in the event that the thermally-responsive actuator fails to operate to disconnect the power supply to the element.

20. An electric immersion heater as claimed in claim 19 wherein the secondary actuator comprises a thermal fuse associated with the link.

21. An electric immersion heater as claimed in claim 20 wherein the thermal fuse comprises a spring loaded, thermally deformable member engaging the link.

22. An electric immersion heater as claimed in claim 21 wherein the thermal fuse engages the link on an opposite side to that with which the primary actuator engages.

23. An electric immersion heater as claimed in claim 1 having a thermally-responsive actuator mounted to the link.

24. An electric immersion heater comprising:

a metal sheathed heating element formed to provide two end portions and an intermediate return portion adjacent the end portions; and a heat conduction link of sheet material of high thermal conductivity attached at a first end to and extending substantially completely around the return portion of the element in good thermal contact therewith, a second end of the heat conduction link and the end portions of the element being arranged so that in use they are adapted to extend through sealing means disposed in at least one opening in a wall of a liquid heating chamber such that, from outside the chamber, electrical connections can be made to the end portions of the element and thermally-responsive control means can be associated with the second end of the heat conduction link, a portion of the link extending around the return portion being attached back onto itself.

25. An electric immersion heater comprising:

a metal sheathed heating element formed to provide two end portions and an intermediate return portion adjacent the end portions;

a heat conduction link of sheet material of high thermal conductivity attached at a first end to and extending substantially completely around the return portion of the element in good thermal contact therewith, a second end of the heat conduction link and the end portions of the element being arranged so that in use they are adapted to extend through sealing means disposed in at least one opening in a wall of a liquid heating chamber such that, from outside the chamber, electrical connections can be made to the end portions of the element and thermally-responsive control means can be associated with the second end of the heat conduction link, a portion of the link extending around the return portion being attached back onto itself; and a plastic head member for mounting the heater in an opening in a wall of a water heating chamber, the end portions of the element and the link extending through sealing means in the head member, the link being folded to lie generally parallel to a back of the head.

26. An electric immersion heater as claimed in claim 24 or 25 wherein the link is of cooper and a sheath of the element is of stainless steel.

27. An electric immersion heater as claimed in claim 26 wherein a side of the link not in contact with the return portion is clad with stainless steel.

28. An electric immersion heater as claimed in claim 24 or 25 wherein the portion is brazed back onto itself.

29. An electric heating appliance comprising:

a heating chamber having an opening in a wall thereof; and an immersion heater secured in the opening, the immersion heater including a metal sheathed heating element formed to provide two end portions and an intermediate return portion adjacent the end portions, and a heat conduction link of sheet material of high thermal conductivity attached at a first end to and extending substantially completely around the return portion of the element in good thermal contact therewith;

sealing means arranged to seal the opening, the heat conduction link and the end portions of the element extending through the sealing means; and a thermally responsive control associated with the heat conduction link on a dry side of the sealing means.

* * * * *